United States Patent [19]

Waslo et al.

[11] Patent Number: 4,984,429

[45] Date of Patent: Jan. 15, 1991

[54] IMPINGEMENT COOLED LINER FOR DRY LOW NOX VENTURI COMBUSTOR

[75] Inventors: Jennifer Waslo, Scotia; Masayoshi Kuwata, Ballston Lake; Roy M. Washam, Schenectady, all of N.Y.

[73] Assignee: General Electric Company, Schenectady, N.Y.

[21] Appl. No.: 934,755

[22] Filed: Nov. 25, 1986

[51] Int. Cl.[5] ..... F02G 1/00

[52] U.S. Cl. ..... 60/752; 60/757

[58] Field of Search ..... 60/752, 754, 757, 759

[56] References Cited

U.S. PATENT DOCUMENTS

| | | | |
|---|---|---|---|
| 3,905,192 | 9/1975 | Pierce et al. | 60/737 |
| 4,109,459 | 8/1978 | Ekstedt et al. | 60/757 |
| 4,292,801 | 10/1981 | Wilkes et al. . | |
| 4,480,436 | 11/1984 | Maclin | 60/752 |
| 4,555,901 | 12/1985 | Wakeman et al. | 60/752 |
| 4,567,730 | 2/1986 | Scott | 60/753 |

FOREIGN PATENT DOCUMENTS

| | | | |
|---|---|---|---|
| 2125950 | 2/1984 | United Kingdom | 60/752 |

OTHER PUBLICATIONS

Nealy, D. A. Reider, S. B., "Evaluation of Laminated Porous Wall Materials for Combustor Liner cooling"; *Transactions of the ASME*, vol. 102, pp. 268–269, Apr. 1980.

*Primary Examiner*—Louis J. Casaregola
*Assistant Examiner*—T. S. Thorpe
*Attorney, Agent, or Firm*—Nixon & Vanderhye

[57] ABSTRACT

It has been found that in a dry low NOx combustor of the type having an upstream combustion chamber and a downstream combustion chamber interconnected by a venturi section, the fuel-air ratio and uniform fuel-air mixing can be improved by providing an annular shield upstream of the venturi region. The shield is impingement cooled through the venturi and provision is made for dumping cooling air farther downsteam in the downstream combustion chamber. With the aforesaid improvements in mind, the upstream combustion chamber is provided with first and second inner liners which are also impringement cooled an which provide combustion air farther upstream into the upstream combustion chamber to further improve fuel-air mixing and to maintain the desired fuel-air ratio.

6 Claims, 2 Drawing Sheets

IMPINGEMENT COOLED LINER FOR DRY LOW NOX VENTURI COMBUSTOR

BACKGROUND OF THE INVENTION

This invention relates to gas turbine combustors and particularly to gas turbine combustors of the type having an upstream combustion chamber and a downstream combustion chamber interconnected by a venturi throat region.

A dry low NOx combustor is the subject of U.S. Pat. No. 4,292,801 to inventors Wilkes and Hilt which is assigned to the assignee of the present invention. In particular, that patent describes a gas turbine combustor which has an upstream combustion chamber and a downstream combustion chamber interconnected by a venturi throat region. There is an annular array of primary nozzles which input fuel into the upstream combustion chamber and a central nozzle which inputs fuel into the downstream combustion chamber. Low NOx (oxides of nitrogen) output is achieved, in part, by the method of operating the subject combustor which includes operating the combustor in a premix mode during the normal or base load such that the primary nozzles are flamed out but fuel is input through the primary nozzles to premix with combustion air whereupon the mixture is ignited in the downstream combustor chamber by the central nozzle. To achieve success in lowering NOx output in the combustor design it is important that fuel-air mixtures be maintained at specific desired levels and that there is a uniform mixture.

It is also important that the combustor parts be adequately cooled due to the high temperatures found in a gas turbine combustor. One such part is the venturi region of the dual stage, dual mode combustor. Film cooling has been effected in this region on the upstream wall of the venturi throat region but it has been found that introduction of film cooling air in this region has an adverse effect on the uniform fuel-air mixture in this region such that there may be created rich/lean pockets: that is, pockets of unburned fuel or pockets of excess air.

In the upstream combustion chamber fuel and air are premixed for ignition to occur during base load operation in the downstream combustion chamber. It is also important that the mixture profile be flat; that is, a uniform mixture. It is also important that the exact fuel air ratio be employed to improve the low NOx performance of the combustor and that the liner be adequately cooled.

OBJECTS OF THE INVENTION

It is accordingly one object of the present invention, to provide improved air-fuel mixing in the venturi throat region of a gas turbine combustor.

It is another object of the invention to provide sufficient cooling of the combustor parts in the venturi throat region of a gas turbine combustor.

It is another object of the invention to maintain the proper fuel-air ratio in the venturi throat of a gas turbine combustor.

It is still a further object of the invention to provide an improved fuel air mixing profile in the primary combustion chamber.

The novel features believed characteristic of the present invention are set forth in the appended claims. The invention itself, however, together with further objects and advantages thereof may best be understood with reference to the following description and drawings.

SUMMARY OF THE INVENTION

An annular shield is positioned in a gas turbine combustor having an upstream combustion chamber and a downstream combustion chamber interconnected by a venturi throat region. The annular shield is partially upstream of the venturi throat region and includes a radially inwardly slanted shield portion and an axial shield portion. Both the slanted shield portion and the axial shield portion are impingement cooled by air from the venturi air supply holes. A ring is attached to the venturi throat region to extend in the downstream direction with a complementary portion of the annular shield. In the upstream combustion chamber, first and second inner annular liners extend in the upstream direction and are cooled by impingement cooling from the combustor liner and centerbody wall respectively. The first and second inner annular liners are open at their upstream ends to dump combustion air into the upstream combustion chamber. Film cooling holes are provided upstream of the inner annular liner.

DETAILED DESCRIPTION OF THE PREFERRED EMBODIMENT

Figure 1:
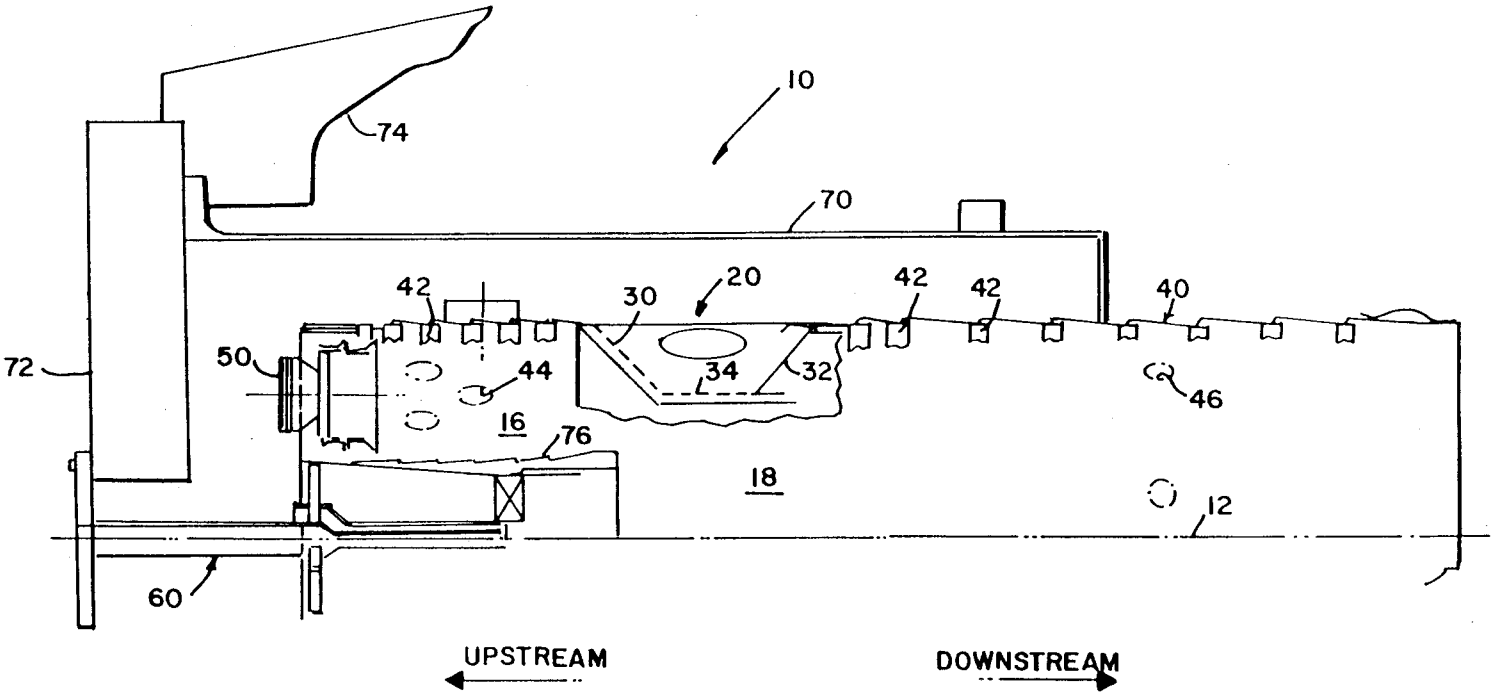
FIG. 1 is an elevation view of a gas turbine combustor with cutaway portions to show the present invention.

FIG. 1 shows a portion of a gas turbine combustor 10 taken around a centerline 12. In U.S. Pat. No. 4,292,801 to inventors Wilkes and Hilt, assigned to the assignee of the present invention and incorporated herein by reference, it is made clear that a gas turbine includes three main parts; that is, a compressor for providing air to a plurality of combustors, and a turbine which is driven by the hot products of combustion and which, in turn, drives the compressor. In one model gas turbine there may be as many as fourteen combustors arranged around the periphery of the gas turbine.

In that same patent,. a unique combustor is shown which is capable of providing a low NOx (oxides of nitrogen) output. A similar combustor is shown in the present invention as having a first stage or upstream combustion chamber 16 and a second stage or downstream combustion chamber 18. These two combustion stages or chambers are interconnected by a venturi throat region 20. The venturi throat region, in general, is a restricted portion between two larger volumes: in this case, the region between the upstream and downstream combustion chambers. The venturi region includes an upstream wall 30 (with respect to the flow direction of the combustion products) and a downstream wall 32 interconnected by an axial wall 34.

To complete the general description of the gas turbine combustor, the upstream and downstream combustion chambers are surrounded by a combustion liner 40 which may include along its axial length a plurality of circumferential slots 42 which provide film cooling within the combustion liner. In addition, there are combustion air holes 44 which provide combustion air into the combustor liner and dilution air holes 46 which quench the combustion process. In each combustor, there are also a plurality of primary fuel nozzles 50 arranged in annular array upstream from the primary combustion chamber; and, in one typical example there may be as many as six primary fuel nozzles per combustor. There may also be one secondary fuel nozzle 60 of the type described in U.S. Patent application Ser. No. 06/934,885 having the same inventors and assignee as the present invention and generally described as a combined diffusion and premix nozzle. The secondary fuel nozzle ignites the fuel flow into the second or downstream combustion chamber during periods when the upstream combustion chambers are used primarily as premix chambers. While the secondary nozzle 60 is shown as the so-called combined diffusion and premix nozzle, it should be understood that this is not a requirement of the present invention and that a simple diffusion nozzle could also be utilized in combination with the present invention.

The combustion liner and its contents, having been described in general terms, is surrounded by a flow sleeve 70 which guides compressor (not shown) discharge air in reverse flow to the combustor liner. Also shown, is an end cover 72 which closes the upstream end of the combustor and locates the secondary fuel nozzle. An annular wrapper 74 (partially shown) surrounds the flow sleeve to complete the construction of the combustor.

Figure 2:
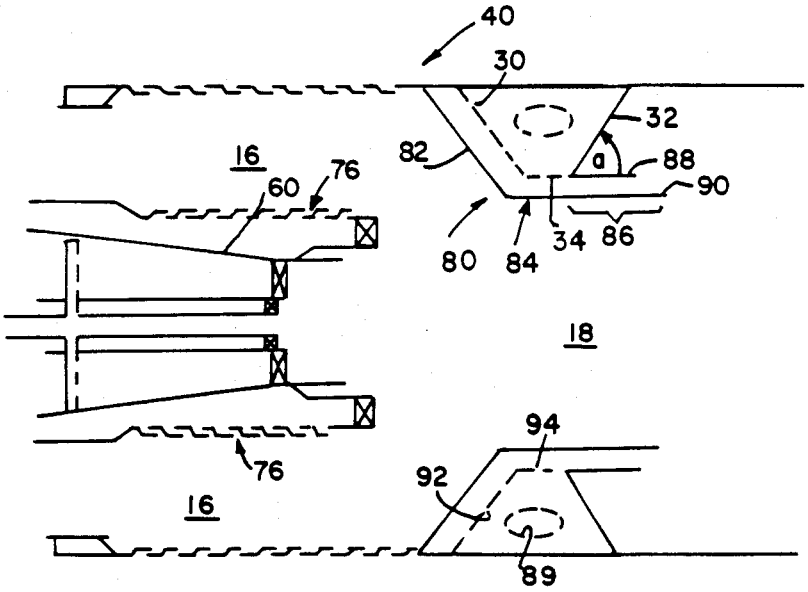
FIG. 2 is a schematic drawing of one embodiment of the present invention and its application to a gas turbine combustor.

Referring now to FIG. 2 in combination with FIG. 1, the combustor liner 40 and its contents as they pertain to the present invention are shown in schematic. The primary nozzles 50 are omitted from the upstream combustion chamber 16 and the secondary nozzle 60 is shown just upstream from the downstream combustion chamber 18. Part of the secondary nozzle is an annular can or cylinder called a centerbody 76. The centerbody is removable from the combustion liner with the secondary nozzle and as indicated by the louvers may be film cooled.

The venturi throat region is described with respect to the direction of combustion products flow as including the upstream wall 30 and the downstream wall 32 interconnected by the axial wall 34. An annular shield 80 comprises a radially inward slanted portion 82 and an axial portion 84. The radially inward slanted portion is positioned upstream from the upstream wall 30 of the venturi and is cooled by impingement cooling holes 92. Cooling air is fed to the upstream wall impingement cooling holes through air supply holes 89 located in the combustion liner. Furthermore, the axial portion of the annular shield is also impingement cooled by means of impingement cooling holes 94 in the venturi axial wall 34. Formerly, the upstream and axial walls of the venturi were film cooled which tended to dilute the fuel/air ratio in the region of the venturi. The present invention will protect the venturi region from the hot combustion products without adding air to the critical burning region.

The axial portion of the annular flow shield is further extended downstream of the venturi axial wall 34 to form an axial extended portion 86. The venturi axial wall is also extended in the axial direction by means of a ring 88 which defines an acute angle "a" with the downstream wall of the venturi. The shield axial extended portion 86 and the ring 88 are substantially coaxial with one another and the centerline axis 12 of the combustor. The addition of the shield axial extended portion 86 and the ring 88 act together to form a flow guide which takes the impingement cooling air downstream in the combustor and away from the flame region thereby disposing of the air in a more favorable region with respect to the maintenance of a desired fuel/air ratio.

Finally, with respect to the annular shield, the shield extended portion has a free end 90 which terminates further downstream in the combustor liner than the free end of the ring 88. This causes the cooling air to inhibit hot combustion gases from contacting the downstream wall of the venturi.

Figure 3:
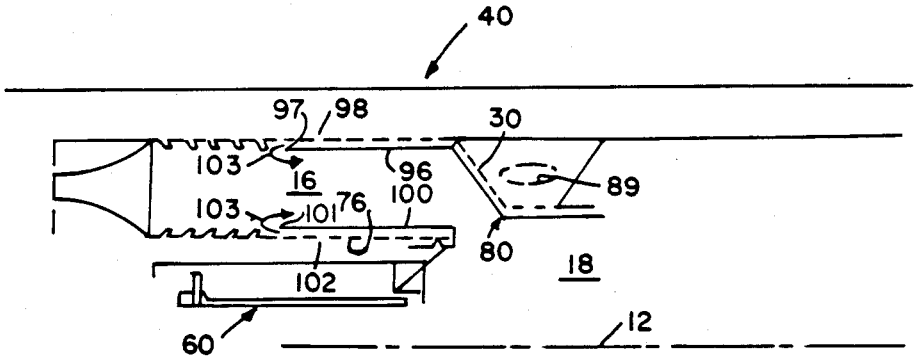
FIG. 3 is a schematic drawing of another embodiment of the present invention and its application to a gas turbine combustor.

Referring to FIG. 3, which is a half elevation view schematic, taken around centerline 12, wherein like numbers are assigned to like parts; there is shown a further improvement to the present invention. In the primary combustion chamber 16, a first inner annular liner 96 extends to a free end 97 upstream from the venturi throat region and is impingement cooled by impingement cooling holes 98 in the combustion liner. Likewise, a second inner annular liner 100 extends to a free end 101 upstream from the venturi throat region but closely adjacent to the centerbody wall 76 and is impingement cooled by means of impingement cooling holes 102 in the centerbody wall. By controlling the spacing of the first and second inner annular liners from the combustion liner and centerbody wall respectively the proper amount of combustion air (see flow arrows 103) for the upstream combustion chamber can be metered to the elimination of the combustion air holes 44 in FIG. 1. The exact dimensions of each inner liner with respect to its adjacent wall could be determined by knowing the desired flow of combustion air and in a manner similar to determining the dimensions of the combustion air holes. As pointed out with respect to the annular shield in the venturi region, the achieved advantage is that the air used for impingement cooling can be added to the combustion zone without diluting the desired fuel/air ratio. The regions upstream from the first and second inner annular liners may be cooled by process of film cooling without adversely affecting the downstream fuel/air mixture.

In accordance with the aforestated objects of the invention, the fuel/air mixture delivered to the venturi region of a dry low NOx combustor has been improved by the cooperation of an annular shield in the venturi region and upstream first and second inner annular liners in the first or upstream combustion zone. The annular shield in the venturi region is impingement cooled with the impingement cooling air being dumped downstream and away from the flame in the secondary fuel nozzle. Correspondingly, the upstream first and second inner annular liners are impingement cooled and dump the impingement air upstream in the first or upstream combustion zone in a metered amount so that a uniform fuel/air mixture (meaning no fuel or air pockets) can be achieved prior to combustion occurring in the venturi region.

While there is described and shown what is considered to be, at present, the preferred embodiment of the invention, it is, of course understood that various other modifications may be made therein. It is intended to claim all such modifications as would fall within the true spirit and scope of the present invention.

What is claimed is:

1. An improved gas turbine combustor of the type having an upstream combustion chamber and a downstream combustion chamber interconnected by a venturi throat region having an upstream wall and a downstream wall interconnected by an axial wall; a plurality of primary nozzles in annular array for introducing fuel into the upstream combustion chamber; a central nozzle for introducing fuel into the downstream combustion chamber; wherein the improvement comprises:

an annular shield positioned, in part, upstream from the venturi throat; the annular shield having a radially inwardly slanted portion and an axial portion;

a plurality of impingement cooling holes in the upstream wall of the venturi region directed at the radially inwardly slanted portion of the annular shield whereby impingement cooling of the slanted shield portion is effected; and further comprising a ring attached to the axial wall of the venturi region and having a free and extending downstream, the ring defining an acute angle with the downstream wall of the venturi region; and an extended portion of the shield axial portion extending downstream and coaxial with the ring.

2. The improvement recited in claim 1, wherein the extended portion of the shield axial portion has a free end terminating beyond the free end of the ring in the downstream direction.

3. A gas turbine combustor having an upstream combustion chamber and a downstream combustion chamber interconnected by a venturi throat region having an upstream wall and a downstream wall interconnected by an axial wall; a plurality of primary nozzles in annular array for introducing fuel into the upstream combustion chamber; and wherein the combustor further comprises:

an annular shield positioned, in part, upstream from the venturi throat region; the annular shield having a radially inwardly slanted portion and an axial portion;

a plurality of impingement cooling holes in the upstream wall of the venturi region and in the axial wall; the impingement cooling holes being directed at the radially inwardly slanted shield portion and the axial shield portion whereby impingement cooling of the radially inwardly slanted shield portion and the axial shield portion is effected;

a ring attached to the axial wall of the venturi region and having a free end extending downstream, the ring defining an acute angle with the downstream wall of the venturi region: and, an extended portion of the shield axial portion extending downstream and coaxial with the ring.

4. The combustor recited in claim 3 wherein the upstream combustion chamber is defined by an annular combustor liner extending between the primary nozzles and the venturi throat region, the combustor further comprising:

an inner annular liner extending axially upstream from the venturi throat region towards the primary nozzles: a plurality of impingement cooling holes formed in the combustor liner in the region of the inner annular liner and directed toward the inner annular liner whereby impingement cooling of the inner annular liner is effected.

5. A gas turbine combustor having an upstream combustion chamber and a downstream combustion chamber interconnected by a venturi throat region having an upstream wall and a downstream wall interconnected by an axial wall; a plurality of primary nozzles in annular array for introducing fuel into the upstream combustion chamber; and, wherein the combustor further comprises;

an annular shield positioned, in part, upstream from the venturi throat region; the annular shield having a radially inwardly slanted portion and an axial portion;

a plurality of impingement cooling holes in the upstream wall of the venturi region and in the axial wall; the impingement cooling holes being directed at the radially inwardly slanted shield portion and the axial shield portion whereby impingement cooling of the radially inwardly slanted portion and the axial shield portion is effected;

a ring attached to the axial wall of the venturi region and having a free end extending downstream, the ring defining an acute angle with the downstream wall of the venturi region;

an extended portion of the shield axial portion extending downstream, the ring defining an acute angle with the downstream wall of the venturi region;

an extended portion of the shield axial portion extending downstream and coaxial with the ring; and, the upstream combustion chamber being defined by an annular combustor liner and a centerbody wall extending between the primary nozzles and the venturi throat region; first and second inner annular liners extending to first and second free ends, respectively, located axially upstream from the venturi throat region towards the primary nozzles; a plurality of impingement cooling holes formed in the combustor liner and the centerbody wall in the region of the first and second inner annular liners and directed toward the first and second inner annular liners respectively, whereby impingement cooling of the first and second inner annular liners is effected.

6. The combustor recited in claim 5 wherein there are film cooling holes formed in the annular combustor liner and the centerbody wall upstream from the impingement cooling holes and the free ends of the first and second inner annular liners.

* * * * *